US005179901A

United States Patent [19]

Adcock

[11] Patent Number: 5,179,901

[45] Date of Patent: Jan. 19, 1993

[54] SUBTERRANEAN STORAGE VAULT

[76] Inventor: Gerald L. Adcock, 2033 3rd Ave. North, Lewiston, Id. 83501

[21] Appl. No.: 752,283

[22] Filed: Aug. 29, 1991

[51] Int. Cl.[5] ..... E05G 1/00

[52] U.S. Cl. ..... 109/45; 109/47; 109/53; 109/73

[58] Field of Search ..... 109/45, 47, 53, 56, 109/67, 68, 73, 87

[56] References Cited

U.S. PATENT DOCUMENTS

| | | | |
|---|---|---|---|
| 325,765 | 9/1985 | Petit . | |
| 649,693 | 5/1900 | Hollar . | |
| 801,100 | 10/1905 | McFarland | 109/47 |
| 1,064,085 | 6/1913 | Plante et al. | 109/47 X |
| 1,461,963 | 7/1923 | Bieneck | 109/45 X |
| 1,954,667 | 4/1934 | Ernst . | |
| 1,965,296 | 7/1934 | Miller | 109/45 |
| 2,700,433 | 1/1955 | Ellithorpe | 186/1 |
| 4,022,137 | 5/1977 | Chiu | 109/47 X |
| 4,369,717 | 1/1983 | Bollier | 109/45 |
| 4,625,658 | 12/1986 | Hodges | 109/47 |
| 4,665,839 | 5/1987 | Heyl | 109/24 |

FOREIGN PATENT DOCUMENTS

| | | | |
|---|---|---|---|
| 631896 | 6/1936 | Fed. Rep. of Germany . | |
| 1465133 | 11/1966 | France | 109/45 |
| 407512 | 8/1966 | Switzerland | 109/45 |
| 3626 | of 1875 | United Kingdom . | |
| 159 | of 1887 | United Kingdom . | |
| 4426 | of 1888 | United Kingdom | 109/47 |

*Primary Examiner*—Renee S. Luebke
*Assistant Examiner*—Suzanne L. Dino
*Attorney, Agent, or Firm*—Wells, St. John, Roberts, Gregory & Matkin

[57] ABSTRACT

A storage vault 10 is described for reception within a subterranean bore 11. The storage vault 10 includes a vault casement 15 that releasably receives a carriage 21, a driver 42, and a control system 65 as an assembly therein. The driver 42 is situated axially alongside the carriage 21 and is utilized to extemd and retract, lifting the carriage 21 from a lowered, closed storage condition, to an upwardly disposed access condition, where individual compartments 24 become accessible to a user. The carriage 21 is situated below a lid 57 that is preferably carried on top of the carriage to be moved therewith between open and closed conditions. Motion of the carriage responsive to extension and retraction of the driver is controlled by first and second guides. The first guide is mounted between the carriage and the vault casement 15, while the second guide is mounted between the carriage and the driver 42. The first and second guides 34, 53 further assist in maintaining lateral stability of the carriage when it is in its upward, access position. Compartments are provided in the carriage at opposed ends for at least a portion of the control system circuitry and driver components to facilitate maintenance and repair.

13 Claims, 5 Drawing Sheets

SUBTERRANEAN STORAGE VAULT

TECHNICAL FIELD

The present invention relates to storage vaults, and more particularly to such vaults adapted to be located in subterranean bores.

BACKGROUND OF THE INVENTION

There is a need for storage vaults, especially of a variety that is capable of securing materials such as computer storage files in locations remote from adjacent building structure. In many instances, computer storage files are required to be secured at off-site locations in order to remove them from any potential hazards such as fire, natural disaster, etc. that could otherwise destroy the files in the home structure. Off-site storage is common, for example, in the banking industries. However, the storage sites themselves are subject to similar hazards, such as fire or other natural disasters. A need has therefore remained for a close-by, yet extremely secure storage facilities for articles to be stored.

Vaults have been provided in the past that are adapted for subterranean use, and in which one or more storage compartments are connected to elevator devices to facilitate selective motion of the compartments to above ground access positions. However, many of such vaults include lift mechanisms that are situated within an extension of the subterranean bore below the storage compartments. Others are centrally located within the storage compartments, or are attached relatively permanently within the bottom of the vault bore hole. Such apparatus have the advantages of stable, secure storage. However such advantages are often outweighted by the disadvantages of expense due to the excessively deep excavations they require, or the difficulty in maintenance or repair due to the relatively inaccessible nature of the lift mechanisms.

The present invention, as disclosed herein, provides a solution to the above problems, and unobvious features that over the prior subterranean vaults that enable storage of articles in a secure, subterranean location at minimal expense, while facilitating ready access to the lifting mechanisms for maintenance or repair.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
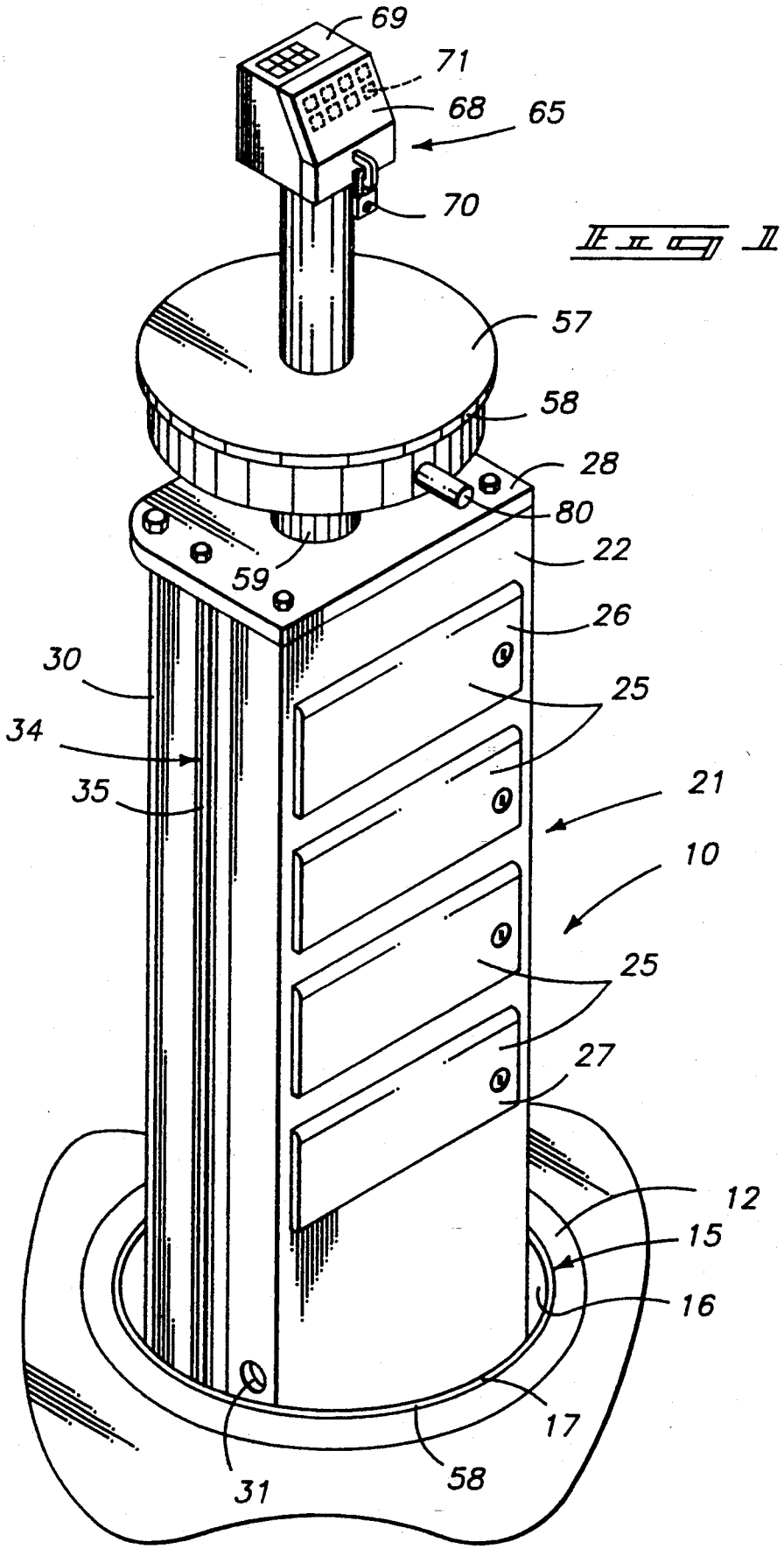
FIG. 1 is a pictorial view of the present storage vault in an upward, access position.
Figure 2:
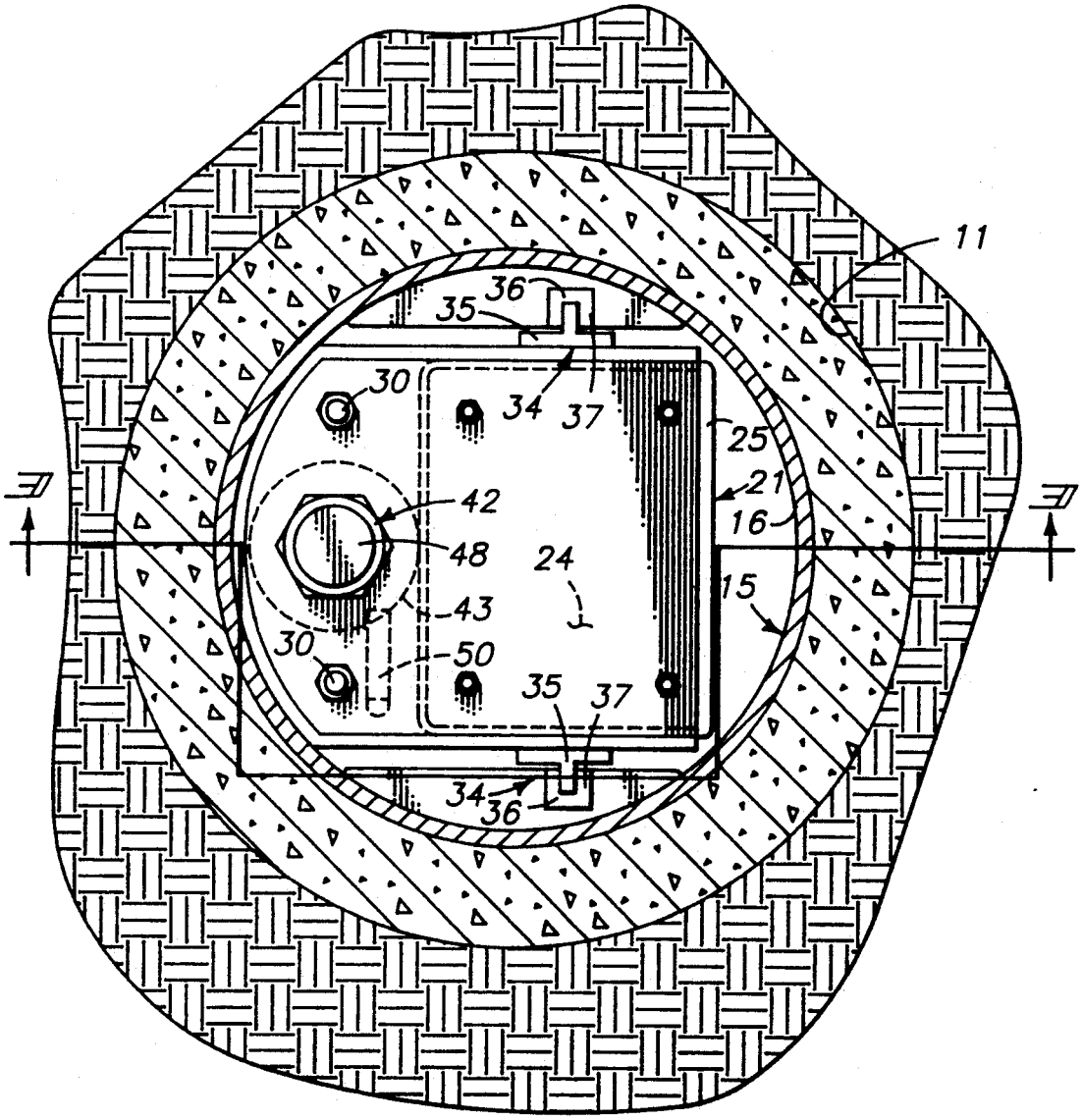
FIG. 2 is a sectional view taken substantially along line 2—2 in FIG. 1.

This disclosure of the invention is submitted in furtherance of the constitutional purposes of the U.S. Patent Laws "to promote the progress of science and useful arts" (Article 1, Section 8).

A storage vault exemplifying a preferred form of the present invention is generally shown in the drawings and is designated therein by the reference character 10.

The present storage vault 10 is intended specifically to be mounted and secured within a subterranean bore 11.

The vault 10 may be placed within a relatively conventional bore 11 formed by conventional boring equipment, and be held in place by concrete grout 12. Such grout may be reinforced as desired to further secure the subterranean location of the vault to prevent unauthorized access and to stabilize the vault and secure it against ground movement, temperature changes or other deleterious effects as in a situation where the structure above may be burning or is otherwise exposed to destructive forces.

The present storage vault 10 includes a vault casement 15. In a preferred form, the vault casement 15 is formed as a cylindrical tube, having a substantially cylindrical wall 16 extending along the casement axis between an open top end 17 and a closed bottom end 18. The casement vault 15 is rigid and formed preferably of a strong, corrosion resistant material such as stainless steel or other appropriate material, closed at the bottom end 18 by similar material.

The closure at the bottom end 18 may be formed as a cap welded or otherwise sealed and rigidly secured to the vault casement 15. The vault casement 15 is therefor closed with the exception of the top opening, so that the internal area confined by the vault is protected from exposure to moisture, gases, etc. from the surrounding subterranean area.

In a preferred form, the vault casement is 26 inches in diameter and approximately 20 feet in length. Other dimensions, especially the axial length dimension may be used according to the needs of the user. A 26 inch casement may be installed within a 32 inch diameter drilled shaft and pressure cemented in place with fire resistant cement grout, along with reinforcement, if desired.

Releasably received within the vault casement 15 is a carriage 21, a driver 42, and portions of a control system 65. It is noteworthy that these components are removably mounted as an assembly within the vault casement. The components can thus be removed as an assembly from the vault casement for ease in maintenance, repair, or replacement.

By way of general description, the carriage 21 is mounted within the vault for movement along the vault casement axis between a storage condition (FIG. 3) and an access position (FIGS. 1 and 4) by selective operation of the driver 42. The driver 42 selectively extends and retracts to shift the carriage 21 between the two positions. The control system 65 is provided to facilitate access to the carriage and the storage units thereon, and for actuating the driver to move the carriage to selected levels. Individual details of the carriage, driver and control system will now follow.

The carriage 21 is elongated, extending from a top end 22 to a bottom end 23. The dimension of the carriage, as with the those of the vault casement may vary according to need for storage space. The length dimension between ends 22 and 23 is axially similar to that of the vault casement 15, the casement being slightly longer to contain the lid 57 and its support, and the bottom end of the driver 42.

The carriage 21, in a preferred embodiment, is comprised of a series of stack of storage compartments 24 individually accessible through access doors 25. The doors 25 may be hinged or otherwise mounted to the compartments and may be selectively opened or closed to gain access to the compartment interiors or to selectively secure the compartments closed. The number and size of compartments, like the casement and carriage dimensions above, may be varied according to need.

It is advantageous that a top control access section 26 be provided adjacent the carriage top 22 to house the components of the control system 65. A lower driver component access section 27 is also provided in the preferred vault construction. Section 27 is intended to receive and mount various driving components including a pump, etc. for supplying pressured fluid to operate the driver 42.

If a hydraulic driver system is used, as preferred, the bottom access section 27 of the carriage is spaced upwardly from the bottom end of the vault casement 18. This is done to avoid possible submersion of the driving components in an area that could be flooded with pressure fluid from a failed driver component. Thus, the driver component access section 27 is situated above a "dead space" that is intended to serve as a potential reservoir, should such ever be required.

Figure 4:
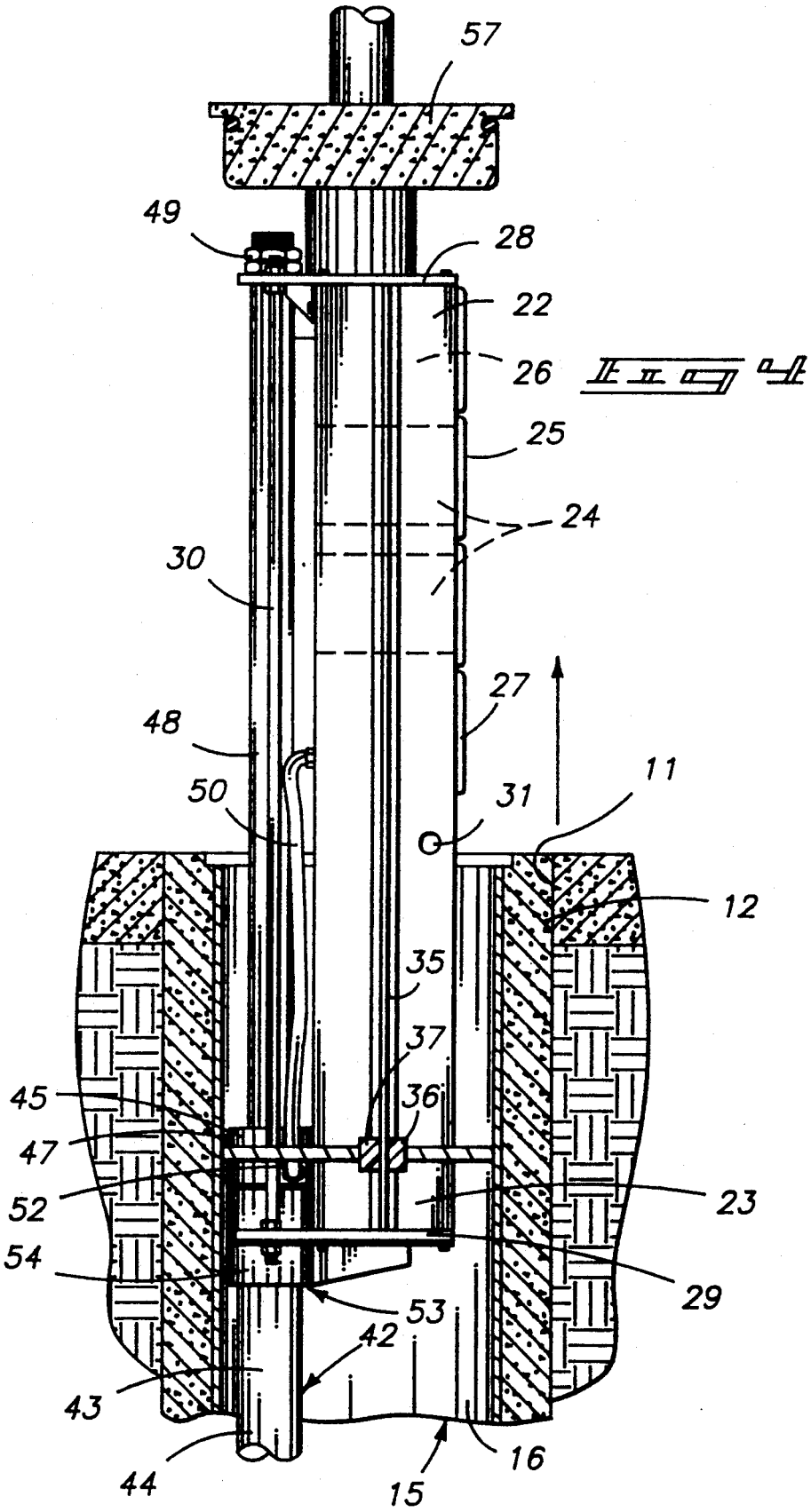
FIG. 4 is a view similar to FIG. 3 only showing the vault in open, access position.

A hole 31 is provided in the carriage, upwardly of the carriage bottom 23. The hole 31 is positioned to align with the top open end 17 of the vault casement 15 when the carriage 21 is in the fully extended, access position as shown in FIG. 4. Hole 31 permits insertion of a bar to lock the carriage in its upward extended condition and to transfer the weight of the carriage and portions of the driver to the vault casement 15 when the carriage or driver is being repaired or maintained.

Axial motion of the carriage 21 within the vault casement follows a first guide 34 situated between the vault casement 15 and carriage 21. The guide 34 confines movement of the carriage to axial motion relative to the casement from the storage position within the vault to the access position outside the vault.

The first guide 34, in a preferred form, is comprised of guide rods 35 mounted on the carriage 21. The guide rods 35 are situated in substantially diametric opposed positions on the sides of the carriage and are aligned with the directional path of the carriage. The guide bars 35 are slidably received by guide ways 36 mounted on the vault wall 16.

The guide ways 36 include, in a preferred form, plastic low friction bushings 37 slidably receiving the guide bars 35 to control or guide axial motion of the carriage and to provide support against lateral tipping motion of the carriage in its fully extended, access position.

Top and bottom plates 28, 29 of the carriage 21 are connected by axial tie rods 30, to secure the stack of compartments 24. The compartments 24 are therefor sandwiched between the plates 28, 29. The guide bars 35 extend between the plates 28, 29. The tie rods 30 laterally stabilize the axial extent of the carriage between the plates 28, 29.

The driver 42 is preferably comprised of an elongated hydraulic cylinder 43 mounted substantially parallel to and laterally adjacent the carriage 21. The cylinder 43 including its piston shaft and base is slightly longer than axial length of the vault casement and is positioned along side the carriage so the assembly does not require excessively deep subterranean bore, as does a system where the lifting device is situated below the storage compartments.

The driver 42 in a first preferred form includes a cylinder body 44 extending between a top end 45 and a bottom end 46. The bottom end 46 closes the cylinder body and extends laterally therefrom, functioning as a base or foot for resting against the vault casement closed bottom 18 and for supporting the cylinder 43. carriage 21 and other components mounted thereon.

A cap 47 including enclosed conventional bushings and seals is situated at the top cylinder body end 45 to slidably seal and guide a piston shaft 48 within the cylinder for axial extension and retraction. A top end of the piston shaft is provided with fastener hardware 49 to secure the piston to the top mounting plate 28 of the carriage 21. Thus the cylinder piston shaft, as it extends due to applied pressure within the cylinder body, will lift the carriage upwardly from the top mounting plate 28 thereof.

The cylinder 43 is preferably a "single action" cylinder, similar to the forms of single action cylinders used in hoists. The internal components of cylinder 43 are conventional and known in the industry and therefore will not be discussed in detail herein.

A pressure hose 50 is connected between the top end 45 of the cylinder body 44 and the driver component access section 27 of the carriage, to a hydraulic pump 51 (shown diagrammatically in FIG. 5) carried therein. The hose 50 is mounted with pivot or swivel connectors 52 to facilitate up and downward motion of the carriage with respect to the stationary cylinder body 44.

The swivel connectors on the hose between the top end of the cylinder and the hydraulic system in the bottom driver component access section 27, facilitate the described motion. The connectors 52 are also exposed when the carriage is elevated to the access position for routine maintenance and repair without necessitating removal of the entire system from the vault.

It is noted once again that the cylinder 43 is mounted alongside the carriage 21. This position maximizes the amount of clear space within the individual storage compartments, and locates the cylinder in an easily accessible location for maintenance and repair. This feature is enhanced by the fact that the carriage and driver mechanisms are removably mounted within the vault casement 15 such that the entire core of the vault can be unlatched and easily removed to facilitate maintenance and repair that would not be as easily accomplished with the driver positioned inside the vault. The present arrangement of elements further facilitates most routine maintenance with the carriage simply extended to the upward, access position (FIGS. 1, 4).

A second guide 53 is provided in a preferred form of the present invention, connecting the carriage 21 with the driver 42 to secure the two together and to further guide movement of the carriage relative to the driver between the storage position within the vault and the access position outside the vault.

The second guide 53 advantageously includes a bushing 54 that slidably engages the cylinder body 44. The bushing 54 will freely slide axially along the length of the cylinder body. Bushing 54 is rigidly secured to the carriage by way of the bottom mounting plate 29. The bushing 54 therefore provides axial guidance of the carriage and cooperates with the first guide 34 to laterally stabilize the carriage during such movement and when the carriage is fully extended. It also secures the carriage to the cylinder, holding the two together (in addition to the connection of the piston and the top plate 28) as an assembly so they may be removed from the vault casement as a unit if removal becomes necessary.

The open top end 17 of the vault casement is selectively closed by a lid 57. In the form exemplified in the drawings, lid 57 is mounted to the top mounting plate 28 on the carriage 21. Thus, the lid 57 is moved between open and closed conditions in conjunction with movement of the carriage between its storage and access positions.

Lid 57 and the open top end 17 of the vault casement 15 include mating seal surfaces 58 that, when engaged, effectively seal the carriage and driver within the vault 10. The vault 10, when so closed, is in the form of a closed cylinder or capsule, with all but the top surface of the lid 57 being situated in the subterranean bore, protected from the environment above. A latch 80 (FIG. 1) of known conventional form may be provided to secure the vault. The latch 80 may be provided on the lid 57 or elsewhere in a hidden location and be electrically operated in the control circuit to lock and unlock the vault in closed storage position.

Figure 5:
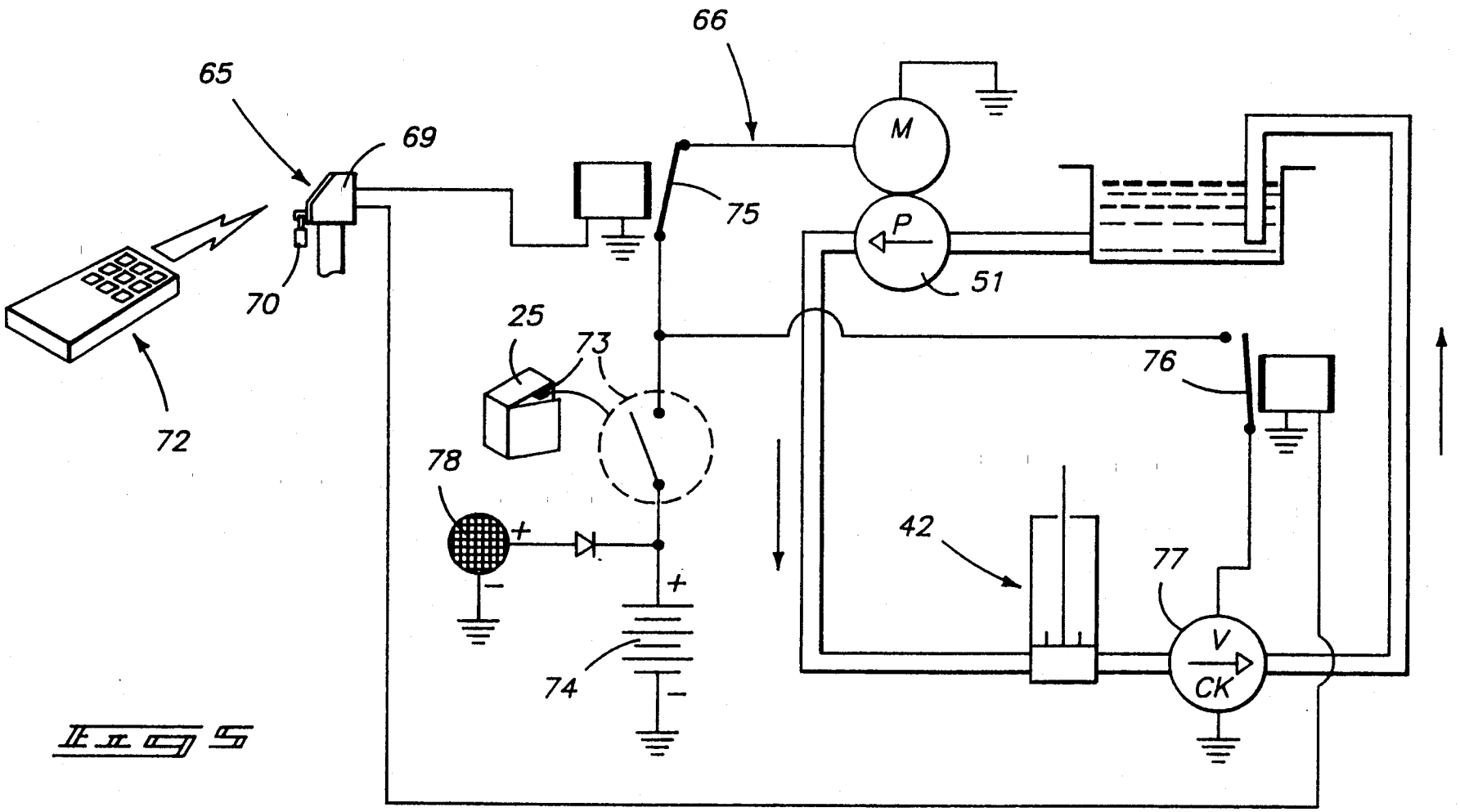
FIG. 5 is a simplified diagram of an exemplary control system and connection thereof to a driver.

In the simplified diagrammatic example shown in FIG. 5, a control system 65 is provided to enable user operation of the driver to move the carriage between the storage and access positions. Features of the control system 65 may be varied and selected according to need and desired operation according to common control system design principles.

An example of preferred components within the control system 65 is shown in FIG. 5 where a circuit 66 is provided, designed using common control engineering practices and conventional components. The system 65 operates through an access control panel 67 with conventional receiver and control processing circuitry (not shown), and a remote controller 72, using conventional design and transmission electronics, that may be handheld by the user. Panel 67 and controller 72 may be selectively used to access the system and to control the amount of extension or retraction of the driver 42 in order to locate a selected compartment 24 on the carriage at a desired level.

Figure 3:
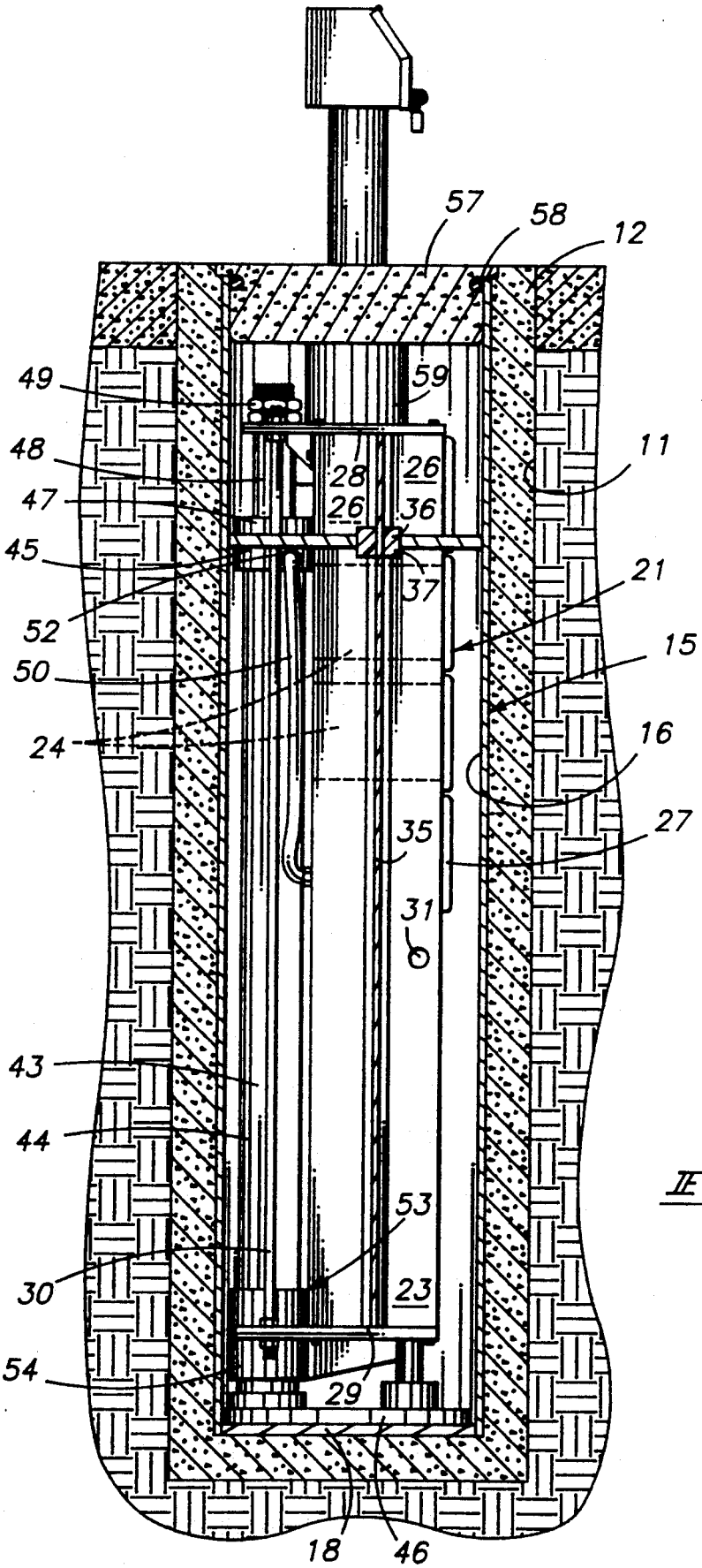
FIG. 3 is a fragmented, longitudinal section of the vault in a storage position.

The access control panel 67 is provided behind a door 68 within a control box 69. The door is selectively closed and locked with a standard lock 70 (FIGS. 3, 5). The control panel 67 includes conventional access keys 71 (FIG. 1), connected with appropriate security accessing circuitry (not shown) to energize the circuit to the driver pump 51, and facilitate operation of the pump to enable selection of an initial position for the carriage. The remote controller 72 may thereafter be used to further select movement through remote operation of respective power and valve relay switches 75, 76 in the circuitry. Switch 75 is used to activate or deactivate the pump 51. Switch 76 is used to open or close a valve 77 to allow the driver to retract under the weight of the carriage back to the storage condition.

It is preferred that switches 73 be provided in the control circuitry and mounted to the compartment access doors 25 to prevent unintentional retraction of the carriage to the storage position with a compartment door in an open condition. Switches 73 function to open the control circuit when a door is open, to disable the driver from moving the carriage until the door is shut.

A power source 74 is provided, preferably using a battery for operational current. A conventional a charging system 78 may be connect the battery using solar energy to recharge the battery. Alternatively a conventional power supply and/or a conventional charging system (not shown) may be selected to maintain a constant available supply of current for operating the driver.

The present storage vault may be easily and relatively quickly installed utilizing conventional drilling and hoist equipment. In preparation for installation, a subterranean drilled bore 11 is formed using conventional earth boring equipment. The overall size of the bore may be determined by the desired thickness of the concrete wall to be placed about the vault casement 15.

The depth of the bore is made according to the selected overall axial length dimension of the vault 10 from the top surface of the lid 57 to the closed bottom end of 18 of the vault casement 15. It is preferred that the bore depth be slightly greater than the overall length in order to facilitate placement of concrete about the sidewall and bottom end of the vault casement 15 as substantially shown at FIG. 3 of the drawings.

When the bore is complete, the vault casement 15 may be lowered into position using conventional hoist equipment. It may be preferred, at this time, to lower the casement 15 alone, without the internal component assembly (the carriage 21, driver 42 and drive and control mechanisms).

The vault casement 15 is simply lowered into the bore, preferably coaxially with the bore so the vault casement wall 16 is uniformly spaced from the bore perimeter. The casement is lowered into the bore to a position where the open top end 17 is at a desired elevation, usually substantially flush with a floor or adjacent ground surface.

Concrete may then be poured about the external perimeter of the vault casement 15. This is done in the conventional manner, and may be accomplished with or without reinforcing steel, depending upon the specification of the user. In fact, it may be desirable simply to place the casement 15 within an earthen bore, without concrete. The procedure, in other words, is discretionary with the installer or purchaser.

Once the vault casement 15 is secured in place, the assembly including the carriage 21, driver 42, lid 57 and control system 65 may be installed (if not previously installed simultaneously with the vault casement). This is done simply by lowering the entire assembly down into the vault 15 so the bottom or foot end 46 of the driver 42 comes to rest against the closed bottom 18 of the vault.

The foot end substantially centers the assembly in position, along with similar centering assistance from the first guide 34. The guide bars 35 are positioned to slide through the guide ways 36, which then at this point serve to locate the driver and carriage, etc. in the desired orientation within the vault 15. Connection may now be made, if so desired, to conventional electric current for operating the control and driver mechanisms. Otherwise, the control system as shown may be provided with its self-sustaining power source including, if desired, the recharging system 78 using solar energy.

To operate the vault, the user simply unlocks and opens the door 68, thereby gaining access to the keyboard access keys 71. The user then may enter a access code and press the appropriate "Enter" key. Completion of the code will switch on power to the hydraulic drive mechanisms and further control devices. Such activation may be indicated by an appropriate light on the control panel. Next, the user may enter a key or keys identifying a particular storage compartment along the carriage 21. This action will enable operation of the remote controller 72 and activate the driver 42 to extend and raise the selected storage compartment to a level accessible to the user.

The remote controller 72 may now be used for additional storage compartment locations and to cause the driver to retract the carriage to the closed, storage condition. Providing the access compartment doors 25 are all closed, the controller may be actuated to open the valve 77 and allow the cylinder to retract, closing the vault to the FIG. 3 position. The user may then close the control panel door and secure the lock 70 in place to prevent unauthorized access to the vault.

It is understood that other control circuitry and systems may be incorporated in the present storage vault, according to the needs or specification of the user. Such circuitry falls well within the skill of the control designer. For example, radio or telephone impulse signals may be used to switch current on, or timers be used to facilitate access to the compartments at only specified times during the day. This technology is well known to the security control industry and may be easily adapted to the present system.

Should there be periodic maintenance required, the maintenance individuals may simply operate the controls as indicated above, to cause the driver to elevate the carriage to the fully extended, access position. The repair or maintenance person may then place a bar through the hole 31, bracing the carriage against the adjacent support surface or the top open end of the vault 15. Thus, the weight of the carriage 21 and hydraulic piston shaft 48 will bear against the bar and the vault 15. The hydraulic drive can then be disconnected and repaired or maintained without fear that the compartment will drop back down into the casing. The drive mechanisms are accessible within the bottom driver component access section 27.

Thus, the repair or maintenance person has access to these systems without requiring that the entire unit be pulled upwardly from the vault. Similarly, the repair or maintenance person has access to control circuitry through the top control access section 26. Thus, all routine maintenance may be performed with the carriage and driver situated within the vault. However, should a major malfunction or damage occur, the entire carriage, driver, and control system may be simply hoisted from the vault for complete access to all components either for repair or replacement after the latching lock bolt 80 is removed or cut as by drilling through the vault casement 15 or lid 57. Location of the latch 80 need be known only to the vault owner. This feature is enabled by the self-contained nature of the components as described above.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A subterranean storage vault, comprising:

a rigid vault casement having a wall extending between a closed bottom end and an open top end, said wall being formed to fit within a subterranean drilled bore;

a lid engagable with the open top end to selectively close the open top end;

a carriage within the vault casement with a receptacle thereon adapted to receive and support an article to be stored;

a first guide between the vault casement and carriage, engaging the carriage to guide movement thereof between a storage position within the vault casement, and an access position outside the vault casement;

a driver comprised of an extensible cylinder mounted within the vault extending alongside the carriage between the carriage and vault casement wall, said cylinder including a piston mounted to the carriage and a cylinder body mounted to the vault casement and selectively operable to move the carriage between the storage and access positions;

a second guide slidably mounted to the cylinder body and attached to the carriage to guide the carriage between the storage position within the vault casement, and the access position outside the vault casement and a control system connected to the driver and a user control device outside the vault casement enabling user operation of the driver to move the carriage between the storage and access positions.

2. A subterranean storage vault, as claimed by claim 1 wherein the carriage, driver, and control system are mounted together in an assembly removably received within the vault casement.

3. A subterranean storage vault, as claimed by claim 1 wherein:

the carriage includes a top end and a bottom end;

wherein the cylinder body extends between a top and a bottom cylinder body end, and wherein the piston extends from the top cylinder body end to the carriage top end; and wherein the second guide is comprised of a bushing slidably mounted to the cylinder body and attached to the carriage adjacent the bottom carriage end to guide the carriage between the storage position within the vault casement, and the access position outside the vault casement.

4. A subterranean storage vault, as claimed by claim 1 wherein the vault casement is formed of a cylindrical tube and wherein the carriage, driver, and control system are removably received in the tube.

5. A subterranean storage vault, as claimed by claim 1 wherein the first guide is comprised of a pair of guide bars extending along the length of the carriage and guide ways mounted to the vault casement.

6. A subterranean storage vault, as claimed by claim 1 wherein the carriage is comprised of a stack of storage compartments with access doors thereon and wherein the control system includes switches on the carriage operated by the doors to deactivate the driver when any one of the doors is open.

7. A subterranean storage vault, as claimed by claim 1 wherein the lid is mounted to the carriage and is movable therewith between the storage position wherein the lid is in contact with the vault casement, and the access position wherein the lid is held by the carriage clear of the vault casement.

8. A subterranean storage vault, as claimed by claim 1 wherein the lid is mounted to the carriage and is movable therewith between the storage position and the access position;

and further comprising seal surfaces on the lid and the vault casement engagable when the carriage is in the storage position to seal the vault casement and separated in the access position wherein the lid is held by the carriage clear of the vault casement; and wherein the control system includes an access control panel mounted to the lid.

9. A subterranean storage vault, as claimed by claim 1 wherein the control system includes an access control panel mounted to the lid.

10. A subterranean storage vault, as claimed by claim 1 wherein the lid is mounted to the carriage and is movable therewith;

and further comprising seal surfaces on the lid and the vault casement wherein the lid seals the open end of the vault casement in the storage position of the carriage, and wherein the seal surfaces are separated in the access position wherein the lid is held by the carriage clear of the vault casement.

11. A subterranean storage vault, as claimed by claim 1 wherein:

the first guide is comprised of a pair of guide bars extending along the length of the carriage and guide ways mounted to the vault casement and slidably receiving the guide bars.

12. A subterranean storage vault, as claimed by claim 1 wherein the lid is mounted to the carriage and is movable therewith between the storage position and the access position and further comprising seal surfaces on the lid and the vault casement wherein the lid seals the open end of the vault casement in the storage position of the carriage, and wherein the seal surfaces are separated in the access position wherein the lid is held by the carriage clear of the vault casement; and wherein the control system includes an access control panel mounted to the lid;

wherein the carriage is comprised of a stack of storage compartments with access doors thereon and wherein the control system further includes switches on the carriage operated by the doors to deactivate the driver when any one of the doors is open.

13. A subterranean storage vault, as claimed by claim 1 wherein:

the first guide is comprised of a guide bar extending along the length of the carriage and a guide way mounted to the vault casement and slidably receiving the guide bar.

* * * * *